US010422353B2

(12) United States Patent
Pippes

(10) Patent No.: US 10,422,353 B2
(45) Date of Patent: Sep. 24, 2019

(54) GAS CHARGING VALVE ARRAY FOR AN ACCUMULATOR

(71) Applicant: Tobul Accumulator Incorporated, Bamberg, SC (US)

(72) Inventor: Thomas Pippes, Houston, TX (US)

(73) Assignee: Tobul Accumulator Incorporated, Bamberg, SC (US)

( * ) Notice: Subject to any disclaimer, the term of this patent is extended or adjusted under 35 U.S.C. 154(b) by 243 days.

(21) Appl. No.: 15/205,153

(22) Filed: Jul. 8, 2016

(65) Prior Publication Data

US 2018/0010618 A1 Jan. 11, 2018

(51) Int. Cl.
*F15B 1/24* (2006.01)
*F15B 1/08* (2006.01)

(52) U.S. Cl.
CPC ..... *F15B 1/24* (2013.01); *F15B 1/08* (2013.01); *F15B 2201/205* (2013.01); *F15B 2201/31* (2013.01); *F15B 2201/405* (2013.01); *F15B 2201/4155* (2013.01)

(58) Field of Classification Search
CPC ..... F15B 1/24; F15B 2201/4155; F15B 2201/205; F15B 2201/31
See application file for complete search history.

(56) References Cited

U.S. PATENT DOCUMENTS

| | | | | |
|---|---|---|---|---|
| 3,228,413 | A | 1/1966 | Stevens | |
| 3,550,818 | A | 12/1970 | Johnston | |
| 3,599,843 | A | 8/1971 | Johnston | |
| 3,610,478 | A | 10/1971 | Johnston | |
| 3,632,023 | A | 1/1972 | Johnston | |
| 3,673,117 | A | 6/1972 | Schroeder et al. | |
| 3,720,355 | A | 3/1973 | Johnston | |
| 3,754,573 | A | 8/1973 | Bales | |
| 3,905,522 | A | 9/1975 | Johnston | |
| 4,350,270 | A | 9/1982 | Nezworski | |
| 5,007,614 | A | 4/1991 | Lockwood, Jr. | |
| 5,048,565 | A | 9/1991 | Oi | |
| 6,505,863 | B2 | 1/2003 | Imai | |
| 7,461,828 | B2 | 12/2008 | Kidprasert | |
| 8,267,123 | B2 * | 9/2012 | LeBlanc | F15B 1/24 138/30 |

* cited by examiner

*Primary Examiner* — Abiy Teka
(74) *Attorney, Agent, or Firm* — Daniel J. Sepanik, Esq.; Harness, Dickey & Pierce, P.L.C.

(57) ABSTRACT

A hydro-pneumatic accumulator includes a housing defining a gas chamber for a compressible gas and a fluid chamber within the housing. A gas valve is in communication with the gas chamber via a gas passage. A check valve is provided within the gas passage and prevents gas from releasing from the gas chamber when the gas valve is removed, wherein the check valve is mechanically actuated to an open position by the gas valve in communication with the gas passage.

11 Claims, 3 Drawing Sheets

GAS CHARGING VALVE ARRAY FOR AN ACCUMULATOR

FIELD

The present disclosure relates to accumulators and more particularly to a gas charging valve array for a hydro-pneumatic accumulator.

BACKGROUND

This section provides background information related to the present disclosure which is not necessarily prior art.

A hydraulic accumulator is a device in which potential energy is stored in the form of a compressed gas or spring, or by a raised weight to be used to exert a force against a relatively incompressible fluid.

Accumulators are used in fluid power systems to accumulate energy and to smooth out pulsations. A hydraulic system utilizing an accumulator can use a smaller fluid pump since the accumulator stores energy from the pump during low demand periods. This energy is available for instantaneous use, released upon demand at a rate many times greater than could be supplied by the pump alone.

Accumulators can also act as surge or pulsation absorbers, much as an air dome is used on pulsating piston or rotary pumps. They will cushion hydraulic hammer, reducing shocks caused by rapid operation or sudden starting and stopping of power cylinders in a hydraulic circuit.

There are three principal types of accumulators, the weight loaded: piston type, the spring loaded; piston type and the gas loaded piston, bladder, diaphragm and metal bellows type. Both the weight loaded type, and spring loaded type are very seldom used today. The gas loaded types use a gas as a spring cushion in conjunction with a hydraulic fluid, the gas and fluid being separated by a thin diaphragm, bladder, piston or bellows.

Hydro-pneumatic accumulators incorporate a gas in conjunction with a hydraulic fluid. The fluid has little dynamic power storage qualities. The fluid normally used in fluid power applications can be reduced in volume only about 1.7% under a pressure of 5000 PSI. Therefore when only 2% of the total contained volume is released, the pressure of the remaining oil in the system will drop to zero. However, the relative incompressibility of a hydraulic fluid makes it ideal for fluid power systems and provides quick response to power demand.

The gas in a hydro-pneumatic accumulator is a partner to the hydraulic fluid and can be compressed to high pressures and low volumes. Potential energy is stored in this compressed gas to be released upon demand. In the piston type accumulator the energy in the compressed gas exerts pressure against the piston separating the gas and hydraulic fluid. The piston in turn forces the fluid from the cylinder into the system and to the location where useful work will be accomplished.

According to the state-of-the-art, all known types of gas charging valves for accumulators require a full discharging of the gas pressure while replacing the gas valve. In subsea blow out preventer applications for oil drilling, accumulator capacities exceeding 100 gallons are common. The discharging and recharging of such large accumulators is very time-consuming and a very critical time factor on deep water blow out preventers. Also the high amount of the gas, typically nitrogen, which is lost while replacing the valve, is very cost intensive. The aim of the present disclosure is to provide a solution to this issue.

SUMMARY

This section provides a general summary of the disclosure, and is not a comprehensive disclosure of its full scope or all of its features.

A hydro-pneumatic accumulator is provided including a housing defining a gas chamber for a compressible gas and a fluid chamber within the housing. A gas valve is in communication with the gas chamber via a gas passage. A check valve is provided within the gas passage and prevents gas from releasing from the gas chamber when the gas valve is removed. The check valve is mechanically actuated and maintained in an open position by the gas valve when it is mounted to the gas passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
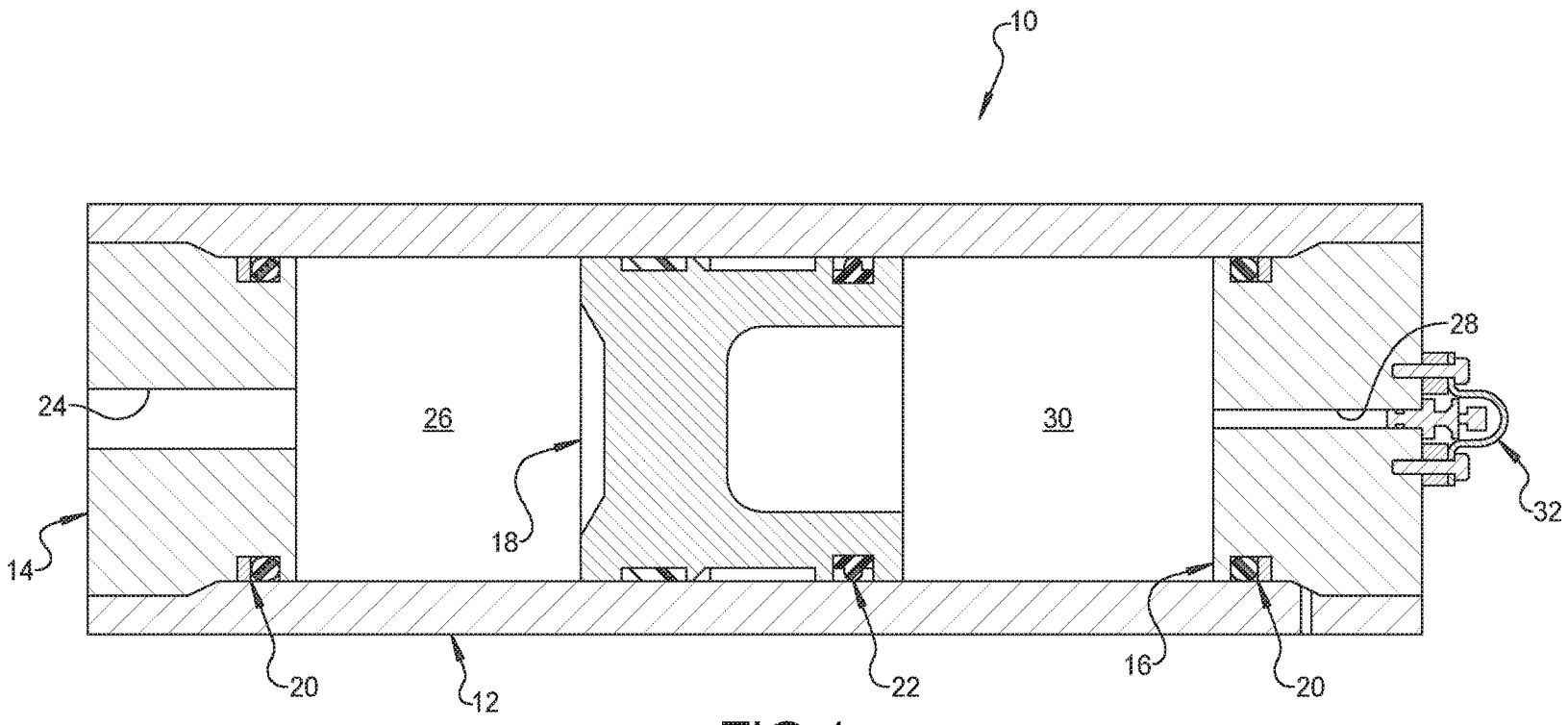
FIG. 1 is a cross-sectional view of an exemplary hydro-pneumatic accumulator having the valve array according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a hydro-pneumatic accumulator 10 is shown including a housing 12 that can be in the form of a cylinder that includes a fluid head 14 at one end and a gas head 16 at a second end. A piston 18 is disposed within the cylinder and is movable relative to the fluid head 14 and gas head 16. Appropriate seals 20 can be utilized between the housing 12 and each of the fluid and gas heads 14, 16. In addition, a seal 22 can be provided on the piston 18. The fluid head 14 can include a fluid passage 24 therein to allow for the ingress and egress of fluid there through to a fluid chamber 26. The gas head 16 can include a gas passage 28 therein to allow for the ingress and egress of gas therethrough to a gas chamber 30.

Figure 2:
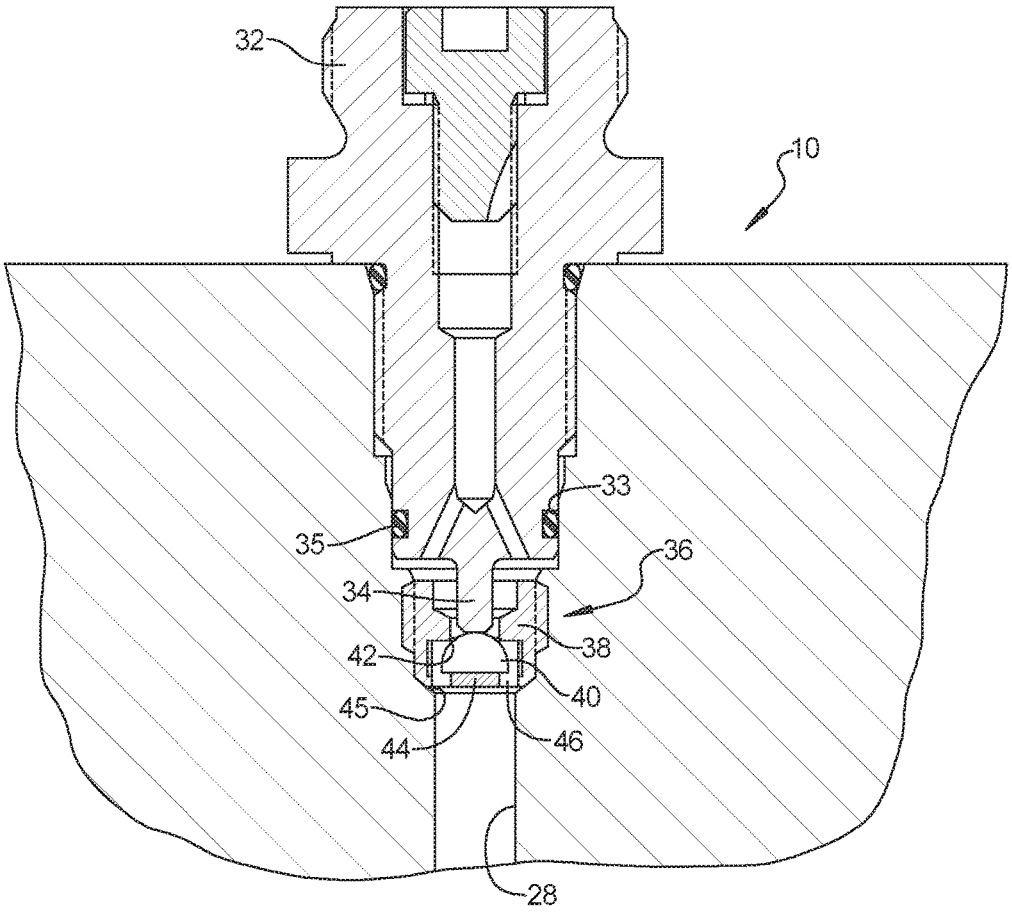
FIG. 2 is a cross-sectional view of an integrated valve array according to the principles of the present disclosure.

With reference to FIG. 2, a gas valve 32 is connected to the gas passage 28. The gas valve 32 includes a recessed annular groove 33 that receives an seal 35 for sealing against the gas passage 28. The gas valve 32 can include a push pin 34 which can open a check valve assembly 36 when the gas valve 32 is installed in communication with the gas passage 28. The check valve assembly 36 can include a fitting body 38 that can be threadably received within the gas passage 28. A movable valve member 40 can be engageable with a seat portion 42 of the fitting body 38 when the push pin 34 is withdrawn from the gas passage 28. A retainer plate 44 can be disposed within the gas passage 28 against a shoulder 45 in order to retain the valve member 40 within the check valve assembly 36. The retainer plate 44 can include a plurality of apertures 46 therein to allow the flow of gas therethrough when the check valve assembly 36 is held in an open position by the push pin 34. The valve member 40 can take on any known form of check valve including but not limited to a floating valve member, a ball, a reed valve, by way of example.

When the gas valve 32 is removed from the housing 12, the push pin 34 is disengaged from the valve member 40 so that the gas pressure or a spring within the gas chamber 30 causes the valve member 40 to seat against the seat portion 42 and prevent the release of the pressurized gas while the gas valve 32 is being maintained or replaced.

Figure 3:
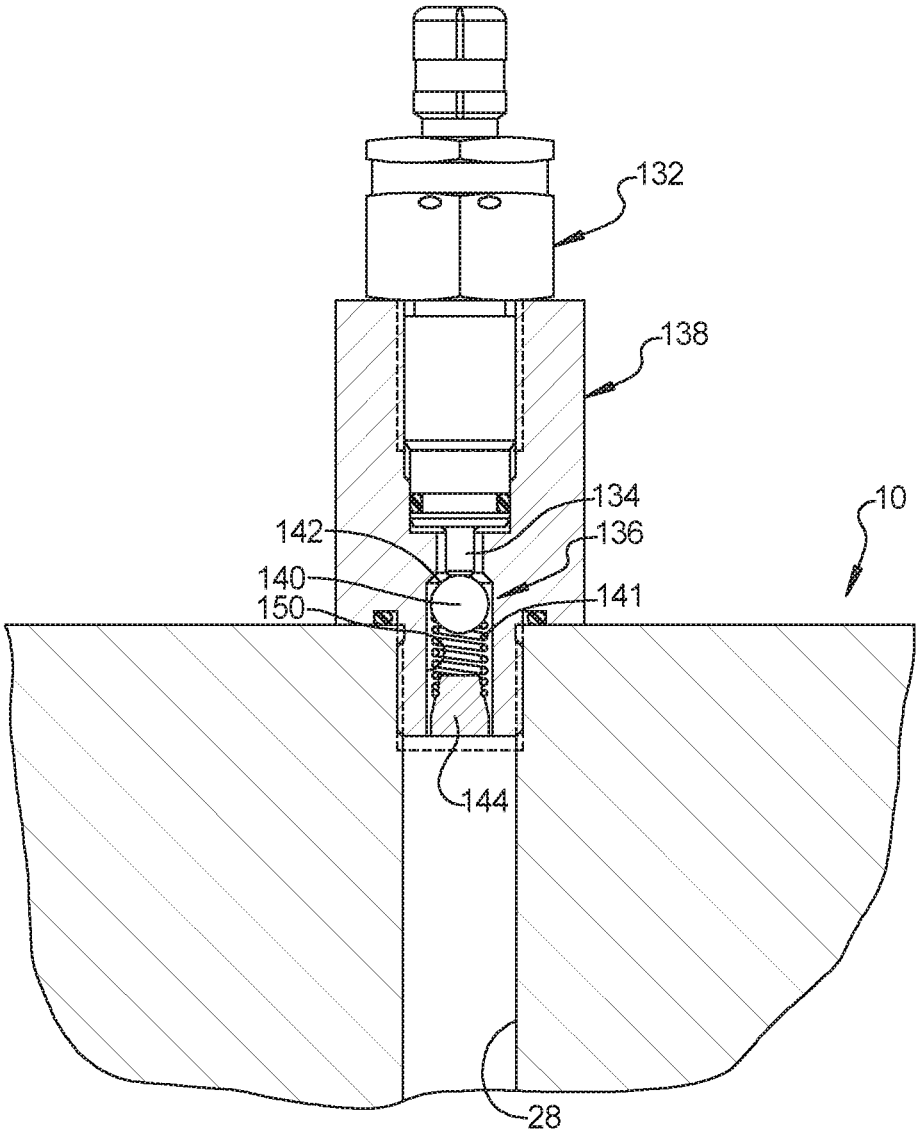
FIG. 3 is a cross-sectional view of a retrofit valve array according to the principles of the present disclosure.

With reference to FIG. 3, an alternative gas valve 132 and fitting body 138 are provided for retrofitting an accumulator 10 to include a valve array. The gas valve 132 can include a push pin 134 which can open a check valve assembly 136 when the gas valve 132 is installed in communication with the gas passage 28. The check valve assembly 136 can include a movable valve member 140 that can be engageable with a seat portion 142 of the fitting body 138 when the push pin 134 is withdrawn from the gas passage 28. A retainer 144 can be disposed within passage 150 in order to retain the valve member 140 and a biasing spring 141 within the check valve assembly 136. The retainer 144 can include a plurality of flow passages therein to allow the flow of gas therethrough when the check valve assembly 136 is held in an open position by the push pin 134. The valve member 140 can take on any known form of check valve including but not limited to a floating valve member, a ball, a reed valve, by way of example. When the gas valve 132 is removed from the fitting body 138, the push pin 134 is disengaged from the valve member 140 so that the gas pressure and/or the spring 141 within the passage 150 causes the valve member 140 to seat against the seat portion 142 and prevent the release of the pressurized gas while the gas valve 132 is being maintained or replaced.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hydro-pneumatic accumulator, comprising:

a housing defining a gas chamber for a compressible gas and a fluid chamber within the housing, a gas head being mounted at one end of the housing;

a gas valve is in communication with the gas chamber via a gas passage through the gas head; and a check valve disposed directly within the gas passage within the gas head and prevents gas from releasing from the gas chamber when the gas valve is removed, wherein the check valve is mechanically actuated and maintained in an open position by the gas valve in communication with the gas passage.

2. The hydro-pneumatic accumulator according to claim 1, further comprising a piston disposed in the housing between the gas chamber and the fluid chamber.

3. The hydro-pneumatic accumulator according to claim 1, wherein the check valve includes a fitting body received in the gas passage and defining a seat portion that is engageable by a moveable valve member.

4. The hydro-pneumatic accumulator according to claim 3, wherein the check valve includes a retainer disposed within the gas passage.

5. The hydro-pneumatic accumulator according to claim 4, wherein the retainer is disposed against a shoulder in the gas passage.

6. The hydro-pneumatic accumulator according to claim 1, wherein the gas valve includes a push pin that actuates and maintains the check valve in the open position.

7. The hydro-pneumatic accumulator according to claim 1, wherein the gas valve and the check valve are coaxially aligned.

8. The hydro-pneumatic accumulator according to claim 1, wherein the hydro-pneumatic accumulator is a one of a subsea accumulator or a blow-out preventer accumulator.

9. The hydro-pneumatic accumulator according to claim 1, wherein the gas valve includes a valve body with a recessed annular groove including a seal for engaging an interior wall of the gas passage.

10. The hydro-pneumatic accumulator according to claim 1, wherein the check valve is spring biased toward a closed position.

11. A hydro-pneumatic accumulator, comprising:

a housing defining a gas chamber for a compressible gas and a fluid chamber within the housing;

a gas valve is in communication with the gas chamber via a gas passage; and a check valve is disposed in a gas head of the accumulator, and is provided within the gas passage and prevents gas from releasing from the gas chamber when the gas valve is removed, wherein the check valve is mechanically actuated and maintained in an open position by the gas valve in communication with the gas passage, wherein the check valve includes a fitting body received in the gas passage and defining a seat portion that is engageable by a moveable valve member, wherein the check valve includes a retainer disposed within the gas passage, wherein the retainer includes a plurality of apertures therein.

* * * * *